United States Patent [19]

Graef

[11] Patent Number: 5,037,032

[45] Date of Patent: Aug. 6, 1991

[54] FLAT SPRAY NOZZLE

[75] Inventor: Steffen Graef, Regensburg, Fed. Rep. of Germany

[73] Assignee: agrotop GmbH, Fed. Rep. of Germany

[21] Appl. No.: 473,462

[22] Filed: Feb. 1, 1990

[30] Foreign Application Priority Data

Feb. 22, 1989 [DE] Fed. Rep. of Germany ..... 3905452

[51] Int. Cl.[5] ..... B05B 1/00

[52] U.S. Cl. ..... 239/600

[58] Field of Search ..... 239/600, 590, , 590.3, 239/593, 594, 595; 285/921, 370, 397; 138/44, 45

[56] References Cited

U.S. PATENT DOCUMENTS

| | | | |
|---|---|---|---|
| 2,567,818 | 9/1951 | McCracken | 239/DIG. 23 |
| 3,736,966 | 6/1973 | Dichiara | 239/600 |
| 3,799,453 | 3/1974 | Hart | 239/600 |
| 4,185,781 | 1/1980 | O'Brien | 239/600 |
| 4,619,402 | 10/1986 | Yamamoto | 239/600 |

FOREIGN PATENT DOCUMENTS

| | | | |
|---|---|---|---|
| 2460002 | 2/1981 | France | 138/44 |

*Primary Examiner*—Andres Kashnikow
*Assistant Examiner*—Lesley D. Morris
*Attorney, Agent, or Firm*—Learman & McCulloch

[57] ABSTRACT

A flat spray nozzle containing a nozzle carrier, a nozzle orifice and a pre-nozzle. The pre-nozzle is releasably connected to the nozzle orifice. In this way on the one hand good centering of the pre-nozzle is ensured and on the other hand handling, especially cleaning, is made substantially easier.

6 Claims, 2 Drawing Sheets

FLAT SPRAY NOZZLE

The invention relates to a flat spray nozzle and more specifically to a flat spray nozzle having a pre-nozzle which is releasably connected to a nozzle orifice.

BACKGROUND OF THE INVENTION

In order to equalize the flow profile in flat spray nozzles, it is known for a pre-nozzle having a central circular opening to be arranged before the nozzle orifice which is provided with a long nozzle opening.

In a known construction this pre-nozzle is inserted loosely between the nozzle orifice and the nozzle carrier and is held in position by the connecting nut which connects the nozzle orifice to the housing support. The disadvantage of this known construction is the poor centering of the pre-nozzle, as a consequence of which the nozzle openings of the pre-nozzle and the nozzle orifice are not exactly aligned with one another.

In a further known construction the pre-nozzle is pressed into the nozzle orifice. This fixed connection does ensure satisfactory centering, but it excludes the possibility of simple cleaning of the nozzle orifice.

SUMMARY OF THE INVENTION

The object of the invention, therefore, is to avoid the described shortcomings of the known constructions and to construct a flat spray nozzle in such a way that, while simultaneously ensuring good centering of the pre-nozzle, improved handling of the flat jet nozzle, particularly ease of replacement and cleaning of all parts, is ensured.

According to the invention the pre-nozzle is releasably connected to the nozzle orifice. Thus by removing the pre-nozzle it is possible to clean the nozzle orifice easily or to replace the nozzle orifice or pre-nozzle.

On the other hand, the connection of the pre-nozzle and the nozzle orifice not only ensures satisfactory centering of the pre-nozzle but also ensures that these parts hold together, for example when cleaning of the nozzle carrier or a nozzle filter which is frequently connected to the nozzle carrier is to be carried out. In this case, the connection between the nozzle orifice and the pre-nozzle ensures that no foreign bodies can enter the nozzle orifice during dismantling of the nozzle, changing of the nozzle and during the cleaning operation.

THE DRAWINGS

The invention will be described in greater detail below with the aid of the accompanying drawings, wherein.

Figure 1:
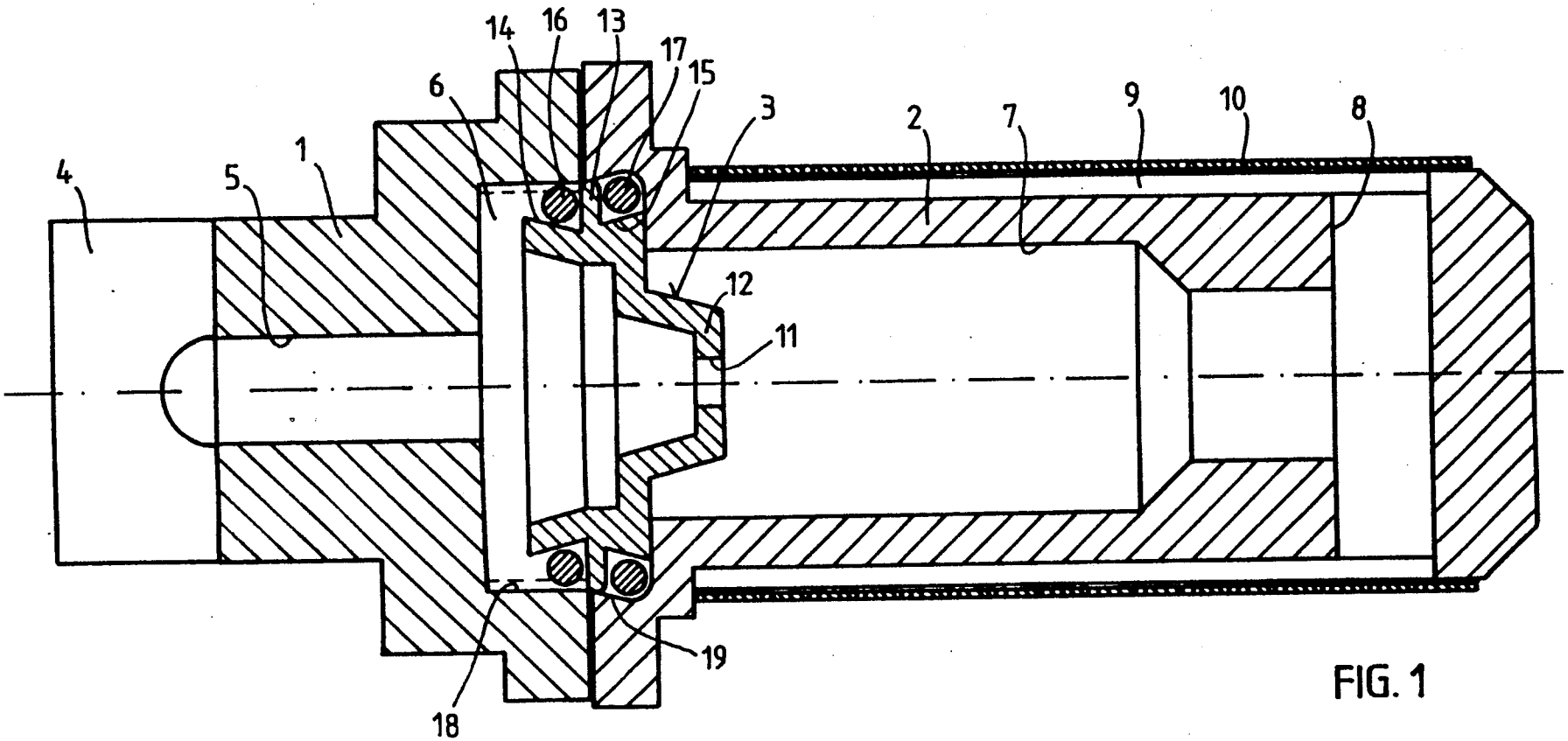
FIG. 1 is a section through a flat spray nozzle provided with a nozzle filter.

The flat spray nozzle shown schematically in FIG. 1 essentially contains a nozzle orifice 1, a nozzle carrier 2 and a pre-nozzle 3.

The nozzle orifice 1 is provided on the outlet side with a slot-shaped nozzle opening 4 into which a central nozzle bore 5 coming from an ante-chamber 6 opens. The ante-chamber 6 includes a cylindrical wall defining an inner surface 18. The nozzle bore 5 has a reduced diameter with respect to the ante-chamber 6 and communicates therewith.

The nozzle carrier 2 is provided with a central bore 7 into which a radial bore 8 opens. Ribs 9, between which channels running in the axial direction are formed, are provided on the periphery of the nozzle carrier 2. The nozzle carrier 2 forms a housing body and is surrounded by a cylindrical screen 10. The carrier body 2 has one end formed with an enlarged opening defining an annular wall having an inner surface 19 in communication with the central bore 7.

The pre-nozzle 3 is arranged between the nozzle orifice 1 and the nozzle carrier 2 and is of cup-shaped construction. The base 12 of the cup-shaped pre-nozzle 3 is provided with a central circular nozzle opening 11 and faces away from the nozzle orifice 1.

The pre-nozzle 3 is provided on its periphery with a flange 13 and has two undercut surfaces 14, 15 adjoining this flange 13.

The flat spray nozzle further includes snap fit means for releasably connecting the pre-nozzle 3 to the nozzle orifice 1 and second snap fit means for releasably connecting the pre-nozzle 3 to the nozzle carrier 2 disposed in the annular chambers which are formed by the flange 13 and the undercut surfaces 14, 15 and which are wedge-shaped in cross-section. The snap fit means for releasably connecting the pre-nozzle 3 to the nozzle orifice 1 and nozzle carrier 2 include two O-rings 16, 17, respectively. O-rings 16, 17 butt on the one hand against the undercut surfaces 14, 15 of the pre-nozzle and on the other hand against the opposing inner surfaces 18 and 19 respectively of the nozzle orifice 1 or the nozzle carrier 2.

The pre-nozzle 3 is releasably connected to the nozzle orifice 1 by means of the O-ring 16. There is also a releasable connection by means of the O-ring 17 between the pre-nozzle 3 and the housing body 2.

The press fit of the O-rings 16 and 17, which are made from elastically deformable material, between the pre-nozzle 3 and the nozzle orifice 1 or the nozzle carrier 2 is advantageously dimensioned so that when the nozzle orifice 1 and the nozzle carrier 2 are taken apart the connection between the pre-nozzle 3 and the nozzle carrier 2 is initially released. The O-ring 17 advantageously remains attached to the pre-nozzle 3. The connection between the pre-nozzle 3 and the nozzle orifice 1 is initially maintained, so that the nozzle carrier 2 and the cylindrical screen 10 of the nozzle filter can be cleaned without any danger of dirt inadvertently entering the interior of the nozzle orifice 1.

If the pre-nozzle 3 is then to be detached from the nozzle orifice 1 (for example in order to replace these two parts or to clean the interior of the nozzle orifice 1), then by sufficiently strong axial traction the connection by means of the O-ring 16 is released. This O-ring 16 advantageously remains on the pre-nozzle on separation of the nozzle orifice 1 and pre-nozzle 3.

Figure 2:
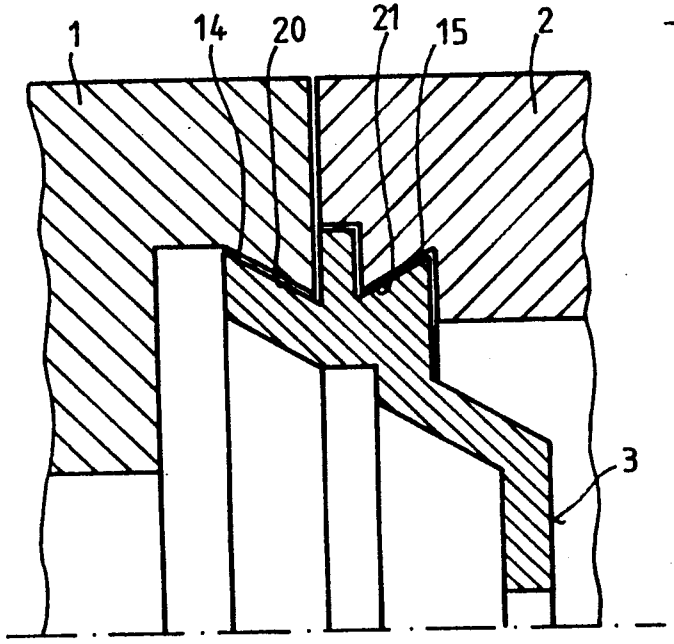
FIG. 2 is a partial section through a further embodiment.

In the variant of the invention which is shown in FIG. 2 the same components are provided with the same reference numerals as in FIG. 1. The pre-nozzle 3 and the nozzle orifice 1 are provided with undercut surfaces 14 and 20 respectively which are in releasably snap engagement with one another. In other words, the undercut surface 14 is in cooperative engagement with the undercut surface 20 to frictionally restrain the nozzle orifice and pre-nozzle 3 against axial separation.

In a corresponding manner an undercut surface 21, which is in releasable snap engagement with the undercut surface 15 of the pre-nozzle 3, is provided on the nozzle carrier 2. As such, the undercut surface 15 is in cooperative engagement with the undercut surface 21 to frictionally restrain the pre-nozzle 3 of nozzle carrier 2 against axial separation.

In this case, too, by suitable dimensioning of the two snap connections it can be ensured that when the nozzle orifice 1 and the nozzle carrier 2 are to be drawn apart in the axial direction the snap connection between the nozzle carrier 2 and the pre-nozzle 3 is released first so that the pre-nozzle 3 remains on the nozzle orifice 1.

Figure 3:
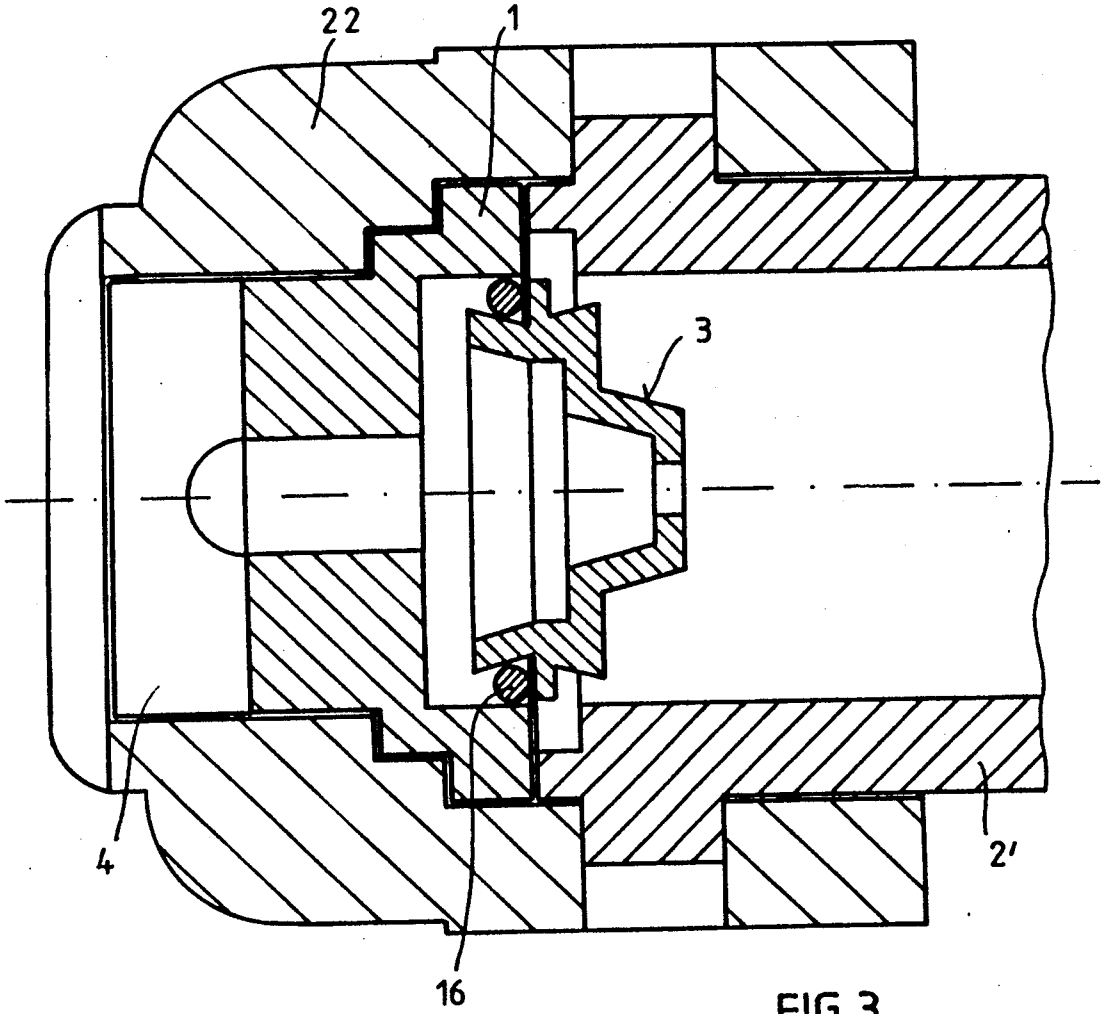
FIG. 3 is a section through a further embodiment.

Finally, FIG. 3 shows an embodiment in which the connection between the nozzle orifice and the nozzle carrier 2' is made by means of a connecting nut 22, preferably by means of a bayonet connection.

In this embodiment the pre-nozzle 3 is releasably connected to the nozzle orifice 1 by means of an O-ring 16 in the manner already described in connection with FIG. 1.

A ball valve can be accommodated for example in the nozzle carrier 2', but this is not shown in detail.

I claim:

1. A flat spray nozzle assembly comprising:

a nozzle orifice fitting formed at one end with an ante-chamber having a cylindrical wall, a nozzle bore communicating at one end with said ante-chamber and having a reduced diameter with respect to said ante-chamber;

a nozzle carrier body having one end formed with an enlarged opening with an annular wall and a central bore of reduced diameter communicating at one end with said enlarged opening;

said nozzle carrier body being disposed in end-to-end axial alignment with said nozzle orifice fitting with said one end of said nozzle fitting abutting said one end of said nozzle carrier body with the ante-chamber and enlarged opening communicating with each other;

a cup shaped pre-nozzle fitting interposed between said nozzle orifice fitting and said nozzle carrier body, said pre-nozzle fitting having a portion projecting into said ante-chamber; and snap fit means releasable connecting said pre-nozzle fitting to said nozzle orifice fitting to frictionally restrain said pre-nozzle fitting and nozzle orifice fitting against axial separation.

2. A flat spray nozzle assembly as claimed in claim 1 wherein said snap fit means includes an annular wedge shaped undercut surface on the portion of the pre-nozzle that projects into said ante-chamber, and an O-ring press-fitted into the space between said wedge-shaped undercut surface and the opposed cylindrical wall of said ante-chamber.

3. A flat spray nozzle assembly as claimed in claim 1 wherein said snap fit means includes a first annular wedge-shaped undercut surface on the portion of the pre-nozzle fitting that projects into said ante-chamber; and a second annular wedge-shaped undercut surface formed on the opposed cylindrical wall of said ante-chamber that is complementary to said first annular wedged-shaped undercut surface and is in cooperative engagement therewith to frictionally restrain said nozzle orifice fitting and pre-nozzle fitting against axial separation.

4. A flat spray nozzle assembly as claimed in claim 1 further including a portion on said pre-nozzle fitting projecting into the enlarged opening of said nozzle carrier body, and second snap fit means releasably connecting said pre-nozzle fitting to said nozzle carrier body.

5. A flat spray nozzle assembly as claimed in claim 4 wherein said second snap fit means includes an annular wedge-shaped undercut surface on the portion of said pre-nozzle that projects into an enlarged opening of said nozzle carrier body, and an O-ring press-fitted into the space between said last named wedge-shaped undercut surface and the opposed annular wall of said enlarged opening.

6. A flat spray nozzle assembly as claimed in claim 4 wherein said second snap fit means includes an annular wedge shaped undercut surface on the portion of said pre-nozzle that projects into second enlarged opening of said nozzle carrier body, said nozzle carrier body including an annular wedge shaped undercut surface formed on the opposed annular wall of said enlarged opening of said carrier body that is complementary to said annular wedge shaped undercut surface on said pre-nozzle and is in cooperative engagement therewith to frictionally restrain said carrier body and said pre-nozzle fitting against axial separation.

* * * * *